US008646217B2

(12) United States Patent
Ratajac

(10) Patent No.: US 8,646,217 B2
(45) Date of Patent: Feb. 11, 2014

(54) DEVICE AND METHODS FOR PREVENTING THE OBSTRUCTION OF GUTTERS BY LEAVES AND OTHER DEBRIS

(76) Inventor: Aleksandar Ratajac, San Diego, CA (US)

( * ) Notice: Subject to any disclaimer, the term of this patent is extended or adjusted under 35 U.S.C. 154(b) by 0 days.

(21) Appl. No.: 13/457,357

(22) Filed: Apr. 26, 2012

(65) Prior Publication Data

US 2013/0283707 A1 Oct. 31, 2013

(51) Int. Cl.
*E04D 13/00* (2006.01)

(52) U.S. Cl.
USPC ..... 52/12; 52/11

(58) Field of Classification Search
USPC ..... 52/11, 12, 14; 210/474
See application file for complete search history.

(56) References Cited

U.S. PATENT DOCUMENTS

| | | | | | |
|---|---|---|---|---|---|
| 265,716 | A | * | 10/1882 | Taylor | 138/163 |
| 316,578 | A | * | 4/1885 | Schumann | 210/162 |
| 524,668 | A | * | 8/1894 | Hawkins | 210/460 |
| 753,660 | A | * | 3/1904 | Boyer | 405/119 |
| 2,533,402 | A | * | 12/1950 | Schmitz, Jr. | 210/463 |
| 2,669,197 | A | * | 2/1954 | Van Duzer | 210/162 |
| 2,875,712 | A | * | 3/1959 | Blau | 210/154 |
| 3,681,925 | A | | 8/1972 | Schmunk et al. | |
| 3,699,684 | A | | 10/1972 | Sixt | |
| 3,958,425 | A | * | 5/1976 | Maroschak | 405/49 |
| 4,239,486 | A | * | 12/1980 | Gomez | 432/225 |
| 4,949,514 | A | | 8/1990 | Weller | |
| 4,950,103 | A | * | 8/1990 | Justice | 405/43 |
| 4,961,442 | A | * | 10/1990 | Crespin et al. | 137/312 |
| 4,964,247 | A | | 10/1990 | Spica | |
| 5,103,601 | A | | 4/1992 | Hunt | |
| 5,107,635 | A | * | 4/1992 | Carpenter | 52/12 |
| 5,242,591 | A | | 9/1993 | Beechert et al. | |
| 5,409,602 | A | * | 4/1995 | Sorenson | 210/162 |
| 5,548,931 | A | * | 8/1996 | Bryant | 52/11 |
| 5,581,934 | A | * | 12/1996 | Arnold, Sr. | 43/64 |
| D390,924 | S | * | 2/1998 | Schlatter | D23/267 |
| 5,791,091 | A | * | 8/1998 | Barbera | 52/12 |
| 5,852,900 | A | | 12/1998 | Edelman | |
| 5,960,590 | A | * | 10/1999 | Hutchison | 52/11 |
| 6,739,800 | B2 | * | 5/2004 | Bevilacqua | 405/48 |
| 7,017,614 | B2 | * | 3/2006 | Handley | 138/109 |
| 7,469,504 | B2 | * | 12/2008 | Nocella | 52/12 |
| 7,544,288 | B1 | | 6/2009 | Cook | |
| 7,740,755 | B2 | | 6/2010 | Wilson et al. | |
| 2004/0006927 | A1 | | 1/2004 | Wickett | |
| 2005/0178072 | A1 | | 8/2005 | Olthoff | |
| 2006/0191208 | A1 | * | 8/2006 | MacIntyre | 52/12 |
| 2008/0271805 | A1 | * | 11/2008 | Presby | 138/138 |
| 2009/0095454 | A1 | * | 4/2009 | MacKelvie | 165/164 |

* cited by examiner

*Primary Examiner* — Basil Katcheves
(74) *Attorney, Agent, or Firm* — Timothy M. Brown, Esq.

(57) ABSTRACT

A gutter insert for preventing the clogging of gutters and devices that are used for conducting a fluid to a desired location. The gutter insert can be connected end-to-end to produce a modular gutter insert having a desired length for placement in a gutter or like device. Closed ends on each segment of the modular gutter insert provide a plurality of internal screens for preventing debris from flowing towards downstream gutter downspouts and outlets.

15 Claims, 5 Drawing Sheets

DEVICE AND METHODS FOR PREVENTING THE OBSTRUCTION OF GUTTERS BY LEAVES AND OTHER DEBRIS

BACKGROUND

The invention relates to devices and methods for preventing the obstruction of gutters by leaves, pine needles and other debris.

Rain gutters provide an effective means for conducting rainwater to a desired location, such as away from the foundation of a home or to a reservoir for collection. Rain gutters however can easily be clogged and rendered ineffective by debris such as leaves and pine needles from trees which are often in close proximity to the home. Even a small handful of debris can block the proper function of a gutter by collecting in the corners and down spouts of rain gutters.

A number of devices have been introduced to protect rain gutters from being clogged by debris. However, many of these devices are difficult and time-consuming to install. For example, many gutter protection devices require the installation of clips and the difficult manipulation of rigid screens which can lead to damage to parts of the home such as shingles and eves, as well as injury to the installer. The location of gutters high on rooftops further complicates their installation. In addition, the installer requires a knowledge of the gutter type, size and configuration to determine compatibility with a given gutter protection device. The combination of the difficulty of installation and required knowledge of compatible shields prevents a large fraction of the home owners from using these products. Moreover, many gutter protection devices often slip out of position after installation due to wind, rain or snow, making these devices require repair and maintenance.

What is needed in the art therefore is a simple, inexpensive device for keeping gutters from being clogged by debris without requiring complicated installation or maintenance.

SUMMARY OF THE INVENTION

The invention overcomes the problems with known gutter protection devices by providing an inexpensive and effective gutter insert that is easily installed within an already mounted rain gutter. The invention does not require complicated brackets, tools or permanently mounted hardware thereby eliminating much of the effort required for maintaining and installing known gutter protection devices, in addition, the gutter inserts of the invention are easily customized to fit a desired length of rain gutter.

It is therefore an object of the invention to provide a modular device for keeping a gutter from being clogged by debris, wherein the device comprises a hollow linear member having a first end and a second end, wherein the hollow linear member is perforated and wherein the first end is configured to connect to the second end thereby allowing a plurality of said modular devices to connect to one another end-to-end for placement inside a gutter.

DETAILED DESCRIPTION

Figure 1:
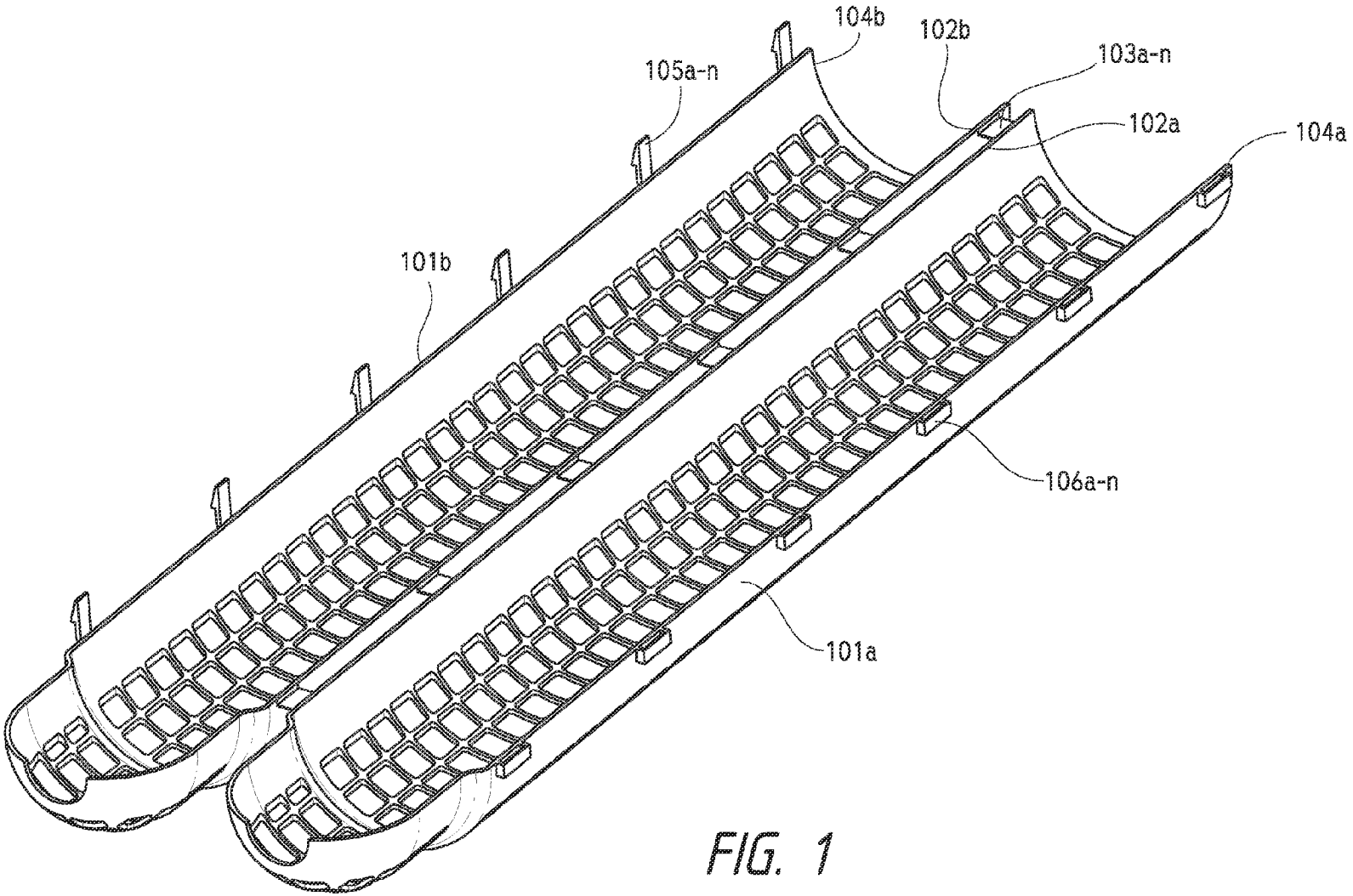
FIG. 1 is perspective view of a device according to the invention wherein the device is in an open configuration.

FIGS. 1-7 show various embodiments of gutter inserts consistent with principles of the present invention. It should be understood that these embodiments are exemplary only and that various features from the embodiments can be imported into other embodiments while remaining consistent with the principles of the present invention. Like reference characters are used wherever possible throughout the figures.

The inventive device relates to a gutter insert for keeping rain gutters and similar devices from being obstructed by debris such as leaves, pine needles, ice, or hail stones, for example. When referring to a gutter, the term "obstructed" or "clogged" means that the flow of water (or other fluid) through the gutter (and/or gutter downspout) is being inhibited by debris by a measurable amount relative to the flow of water through the gutter in the absence of such debris. "Clogging," or "obstruction" therefore includes debris completely preventing the flow of a fluid through a gutter and/or gutter downspout. The term "gutter" as used herein refers to systems for conducting a fluid to desired location. The term gutter includes, but is not limited to, rain gutters and in-ground trenches, for example.

Figures 2, 2A:
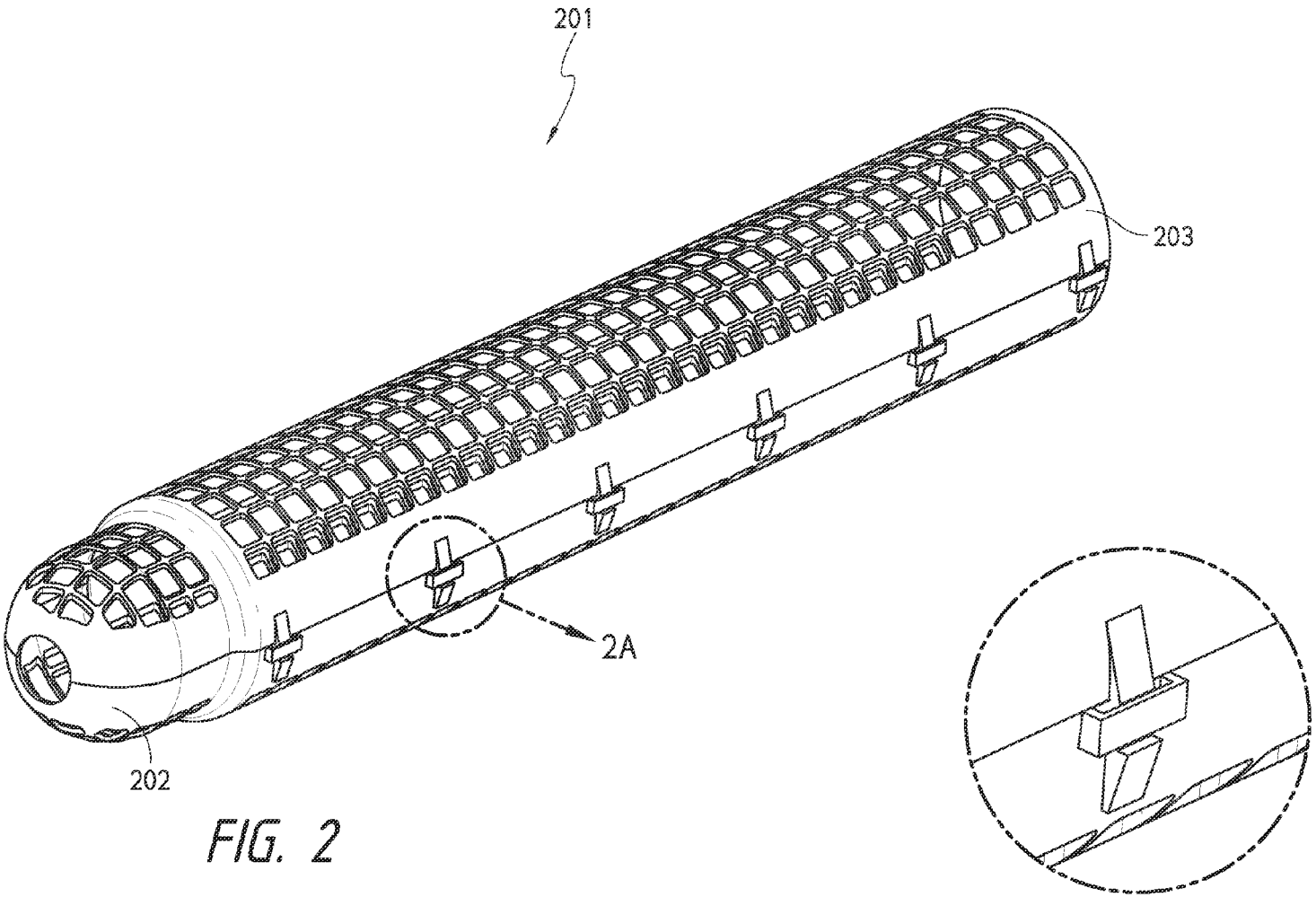
FIG. 2 is a perspective view of a device of according to the invention wherein the device is in a closed configuration.
FIG. 2A is a callout showing a connecting means from FIG. 2.

FIG. 1 depicts a gutter insert according to the invention wherein the insert assumes a hinged arrangement such that the device can be closed to produce the hollow linear body depicted in FIG. 2.

FIG. 1 depicts an embodiment of the inventive gutter insert comprising a pair of opposing halves 101*a* and 101*b* which are perforated along their length. Opposing halves 101*a* and 101*b* are connected to one another along edges 102*a* and 102*b* by hinges 103*a-n*. The perimeter of the device is formed by outer edges 104*a* and 104*b*. Affixed to portions of outer edges 104*a* and 104*b* is a connecting means for holding opposing halves 101*a* and 101*b* together. According to the embodiment depicted in FIG. 1, this connecting means comprises a plurality of hooks 105*a-n* and loops 106*a-n* which interact and lock the device in a closed configuration when opposing halves 101*a* and 101*b* are brought together (see e.g. FIG. 2A). It will be understood however that the gutter inserts of the invention may use a single connecting means, or other locking mechanisms such as a slide lock, ball and socket, zip ties, velcro, or a combination thereof, for example. It will also be understood that opposing halve 101*a* and 101*b* may be separate, unhinged pieces wherein the hinges 103*a-n* are replaced with connecting means that enable opposing halves 101*a* and 101*b* to be held together to form a hollow linear body such as that depicted in FIG. 2.

When opposing halves 101*a* and 101*b* are closed, the device of the invention forms gutter insert 201 as depicted in FIG. 2. Gutter insert 201 has leading end 202 and trailing end. 203. Leading end 202 and trailing end 203 are configured to interact with one another to allow multiple gutter inserts to be connected end-to-end in a modular fashion. In the embodiment depicted in FIG. 2, leading end 202 comprises a taper or neck for fitting within trailing end 203. In the closed position, opposing halves 101*a* and 101*b* form aperture 204. Alternatively, leading end 202 may be free of aperture 204 in which case the area occupied by aperture 204 comprises either a perforated wall or non-perforated (i.e. solid) wall.

Figure 3:
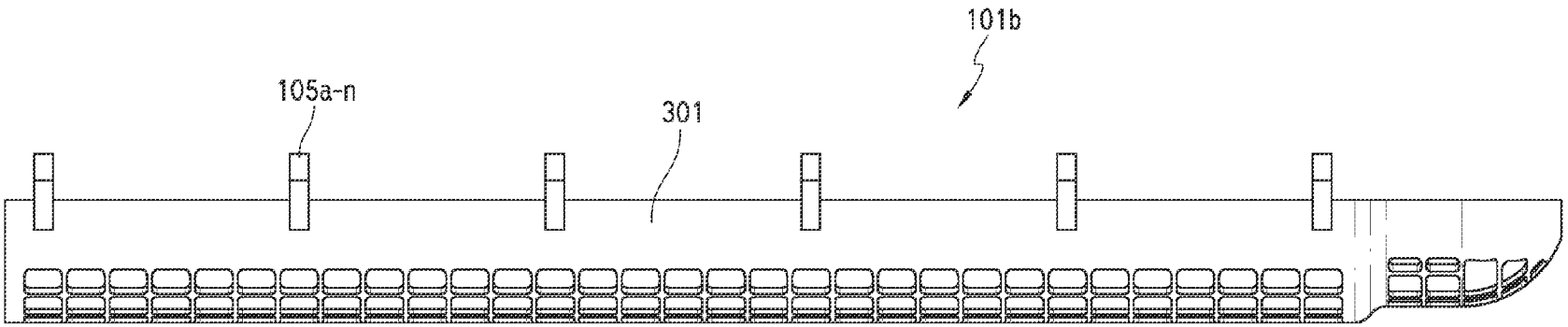
FIG. 3 is a side view of a device according to the invention wherein the device is in an open configuration.

FIG. 3 depicts a side view of half 101*b* with hooks 105*a-n* attached to sidewall 301. Though not depicted directly, it will be appreciated that half 101*a* comprises an opposing sidewall of the similar or the same proportions as sidewall 301, but with loops 106*a-n*.

Figure 5:
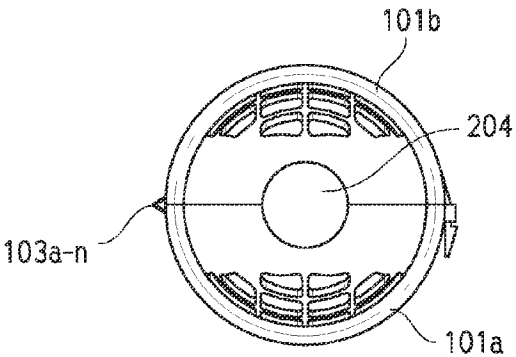
FIG. 5 is an end view of a device according to the invention wherein the device is in a closed configuration.
Figure 4:
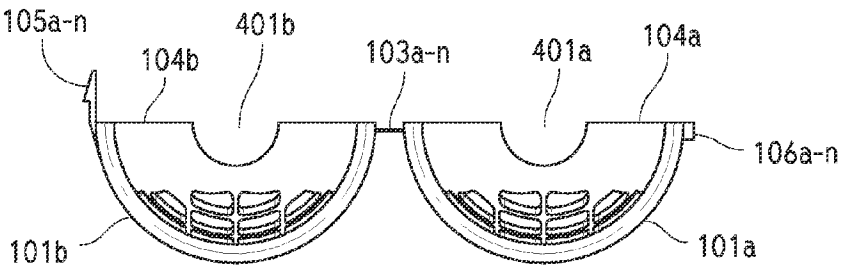
FIG. 4 is an end view of a device according to the invention wherein the device is in an open configuration.

FIG. 4 depicts an end view of leading end 202 of the gutter insert with opposing halves 101*a* and 101*b* in an open configuration. Each of opposing halves 101*a* and 101*b* optionally contain on the end of edges 104*a* and 104*b* a pair of indentations 401*a* and 401*b* that form aperture 204 when opposing halves 101*a* and 101*b* are closed as depicted in FIG. 5. In some aspects of the invention, aperture 204 is larger than the apertures of leading end 202 (and/or the apertures on the neck or taper of leading end 202) so as to permit debris to flow through leading end 202 should the smaller apertures become clogged with debris.

Figure 6:
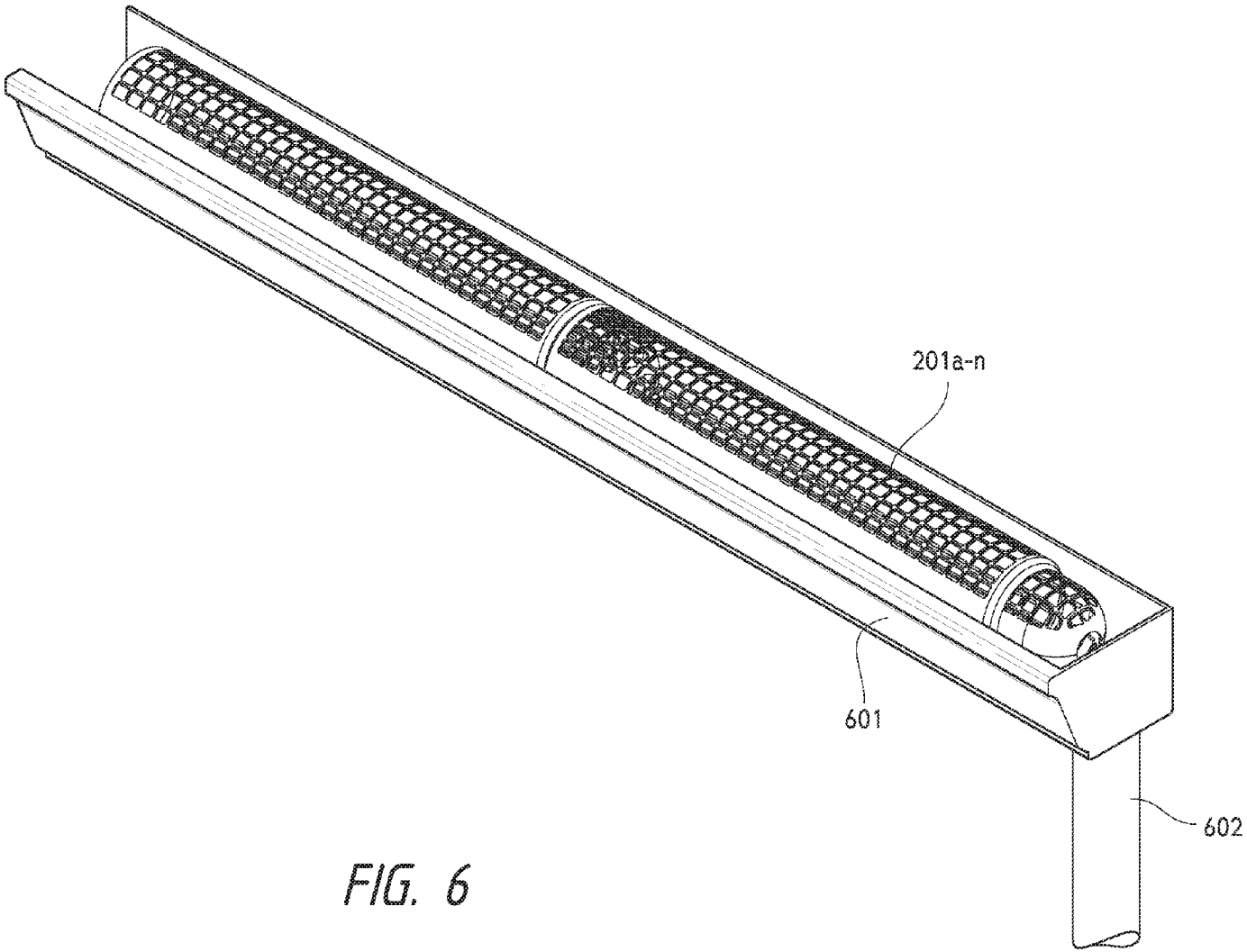
FIG. 6 is an operational view of a device according to the invention wherein the device is installed within a rain gutter.

FIG. 6 depicts an operational view wherein a plurality of gutter inserts 201*a-n* are joined end-to-end in a modular fashion and placed inside gutter 601. As depicted in FIG. 6 gutter inserts 201 *a-n* are preferably of a size and dimension that permits gutter inserts 201*a-n* to fit inside gutter 601. Though not essential, the size and dimension of the inventive device preferably permits gutter inserts 201*a-n* to fit snugly inside gutter 601 so as to prevent gutter inserts 201*a-n* from becoming dislodged from gutter 601. Gutter inserts 201*a-n* may also be of a size and shape wherein the sides of the tubular body do not contact the inner sidewalk of gutter 601. In such configurations, gutter inserts 201*a-n* still form a hollow conduit through which water (or other liquids) may flow despite debris collecting between the inner sidewalls of gutter 601 and the outside wall of gutter inserts 201*a-n*. While the gutter inserts of the invention may comprise any diameter that permits them to be placed within a desired gutter, a non-limiting range for the outside diameter of the gutter inserts is between about 3.25 to 3.5 inches, or greater than 3.25 inches, for example.

In their connected configuration, and still referring to FIG. 6, gutter inserts 201*a-n* form a series of internal screening portions. That is, when the gutter inserts of the invention are connected end-to-end, leading ends 202 create a plurality of closed, perforated walls that prevent the flow of debris that may pass through the outer wall of gutter inserts 201*a-n* thereby preventing such pass-through debris from collecting at gutter downspout 602. In addition, apertures 204 may provide an overflow should the small apertures on leading ends 202 become clogged with pass-through debris.

In operation, the outer perforated walls of gutter inserts 201*a-n* form a barrier to keep debris from entering the hollow space inside gutter inserts 201*a-n*. Should any debris pass through the outer perforated walls of gutter inserts 201*a-n*, such debris may be collected by the perforated barrier(s) formed by leading end 202 thereby preventing such pass-through debris from reaching down spout 602. Thus, the outer walls of gutter inserts 201*a-n* form a first barrier that inhibits debris from entering the inside of the hollow space inside gutter inserts 201*a-n*, white the barrier(s) formed by leading end 202 form a second barrier for keeping pass-through debris from reaching down spout 602. Therefore, when a plurality of gutter inserts 201*a-n* are connected end-to-end, leading ends 202 create a series of internal barriers for capturing any pass-through debris before it can reach down spout 602.

One aspect of the invention concerns the apertures that occupy leading end 202 (including the neck or taper thereof) and the outer walls of opposing halves 101*a* and 101*b* (or gutter insert 201 when opposing halves 101*a* and 101*b* are closed). It will be appreciated that the size and number of apertures that are selected will depend on the size of the debris that is desired to be blocked. Suitable aperture sizes for the opposing halves 101*a* and 101*b* (and leading end 202) include, but are not limited to about ¼ inch to ¾ inch holes. Suitable shapes for such apertures include, but are not limited to, squares; diamonds, ovals, circles, or combinations thereof. Collectively, the apertures may create between about 65%-85% open area, although more or less open area may be utilized without departing from the scope of the invention, provided that such apertures inhibit the passage of debris.

The perforations in the outer walls of gutter inserts 201*a-n* (i.e. opposing halves 101*a* and 101*b*) may be of the same size, or different size, as the perforations of leading end 202. That is, gutter insert 201 (and its individual halves) may have the same open area, more open area or less open area than leading end 202, per square unit of area. In an aspect of the invention, leading end 202 has smaller perforations than the outer wall of gutter insert 201 (i.e. opposing halves 101*a* and 101*b*) so as to catch debris that passes through the larger holes of the outer wall of gutter insert 201 *a-n*.

Figure 7:
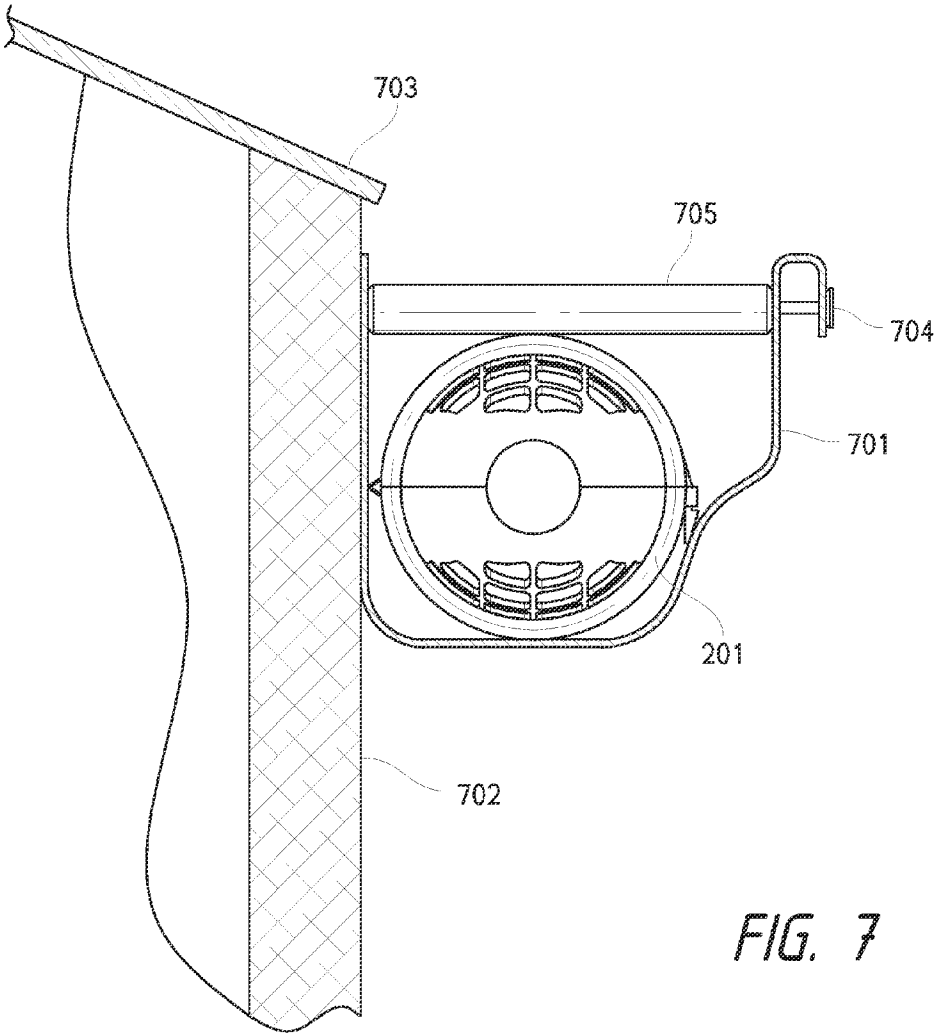
FIG. 7 is an end view of a device according to the invention wherein the device is inside a rain gutter.

FIG. 7 shows an end view of a gutter insert of the invention inside rain gutter 701. Rain gutter 701 is secured to wall 702 next to roof 703 by nail 704 which passes through spacer 705. In some aspects of the invention, gutter insert 201 is of a size and dimension to permit it to fit snugly under spacer 705 so as to secure gutter insert 201 inside rain gutter 701. While depicted with a nail and spacer, the gutter inserts of the invention may be configured to fit snugly under other types of attaching systems that use a cross support member. The gutter inserts of the invention may be of any length that makes it practical to connect a plurality of them together end-to-end so that they can be placed inside a gutter. In some aspects of the invention, the gutter inserts are between about 12 to 24 inches, for example. It should be noted that shorter lengths of the gutter insert may be desirable to create a greater number of internal barriers so that larger amounts of pass-through debris can be collected. The length of gutter insert 201 may of course be shortened by a user by cutting gutter insert 201 to a desired length.

Although the gutter insert of the invention has been described as keeping gutters (e.g. rain gutters) from clogging up, it will be appreciated that the gutter inserts of the invention may be used in other systems that are designed for conducting water to a desired location, such as in-ground trenches. Thus, the particular shape, dimensions and rigidity of the gutter insert of the invention may be modified to fit the water conducting system that is desired to be protected from debris. Gutter insert 201 may therefore assume a variety of shapes including, but not limited to, round, square, elliptical or oval-shaped cylinders.

The gutter inserts of the invention may be made from any material that permits them to be manufactured and used as disclosed herein. Suitable materials for constructing the gutter insert of the invention include, but are not limited to, plastic, stamped sheet metal, wire, or a combination thereof. While the gutter inserts of the invention are depicted as a pair of opposing halves (to facilitate injection molding, for example), it will be appreciated that gutter insert 201 may be formed as a single continuous unit.

Methods of using the presently disclosed gutter insert are also within the scope of the invention. Such methods may be practiced by providing a plurality of gutter inserts and connecting them together end-to-end to form a modular gutter insert, and placing the modular gutter insert inside a rain gutter. As noted above, the gutter inserts of the invention may be modified by having a user cut the gutter insert to a desired length. Thus, it may be desirable to manufacture the gutter insert out of a material such as plastic to permit it to be easily cut by a user by scissors or garden shears, for example.

We claim:

1. A gutter insert configured to rest inside an existing rain gutter and a prevent said rain gutter from becoming obstructed with debris, said gutter insert comprising:

a) a perforated hollow linear member having a first end and a second end; and b) a perforated cylindrical body having a base and terminating in a perforated dome opposite said base, said perforated cylindrical body being connected to said first end of said perforated hollow linear member by said base, wherein said perforated cylindrical body has morons section that is smaller than the cross section of said perforated hollow linear member and is configured to fit inside said second end in a manner that permits a plurality of said gutter inserts to connect to one another end-to-end to form a modular gutter insert;

c) wherein said perforated hollow linear member and said perforated cylindrical body are formed from a pair of opposing portions;

d) at least one hinge joining said pair of opposing portions; and e) a first one or more connections configured to hold said pair of opposing portions a close configuration.

2. The gutter insert of claim 1, wherein said perforated hollow linear member is circular, square or oval.

3. The gutter insert of claim 1, wherein the perforations in said perforated hollow linear member provide said perforated hollow member with at least 65% open surface area.

4. The gutter insert of claim 1, wherein said modular gutter insert comprises (a) an external perforated barrier formed by the perforations in said perforated hollow linear member, and (b) at least one internal perforated barrier formed by said perforated dome, wherein said at least one internal perforated barrier is configured to prevent debris from flowing longitudinally through said modular gutter insert.

5. The gutter insert of claim 1, wherein said pair of opposing portions are joined by a second one or more connections.

6. The gutter insert of claim 1, wherein said perforated dome comprises a center having a circular opening therein.

7. A method for preventing a rain gutter from becoming obstructed with debris, said method comprising:

a) providing a plurality of gutter inserts that are configured to rest inside said rain gutter, each of said plurality of gutter inserts comprising:

i) a perforated hollow linear member having a first end and a second end;

ii) a perforated cylindrical body having a base and terminating in a perforated dome opposite said base, said perforated cylindrical body being connected to said first end by said base, wherein said perforated cylindrical body has a cross section that is smaller than the cross section of said perforated hollow linear member and is configured to fit inside said second end in a manner that permits said plurality of gutter inserts to connect to one another end-to-end to form a modular gutter insert;

iii) wherein each of said plurality of gutter inserts is formed from two opposing linear portions;

iv) at least one hinge joining said opposing linear portions; and v) a first at least one connection configured to hold said opposing linear portions in a closed configuration;

b) connecting said plurality of gutter inserts end to end to form a modular gutter insert; and c) placing said modular gutter insert inside said rain gutter wherein said modular gutter insert prevents debris from obstructing said rain gutter.

8. The method of claim 7, wherein said perforated hollow linear member is circular, square or oval.

9. The method of claim 7, wherein the perforations in said perforated hollow linear member provide said perforated hollow linear member with at least 65% open surface area.

10. The method of claim 7, wherein said modular gutter insert comprises (a) an external perforated barrier formed by the perforations in said perforated hollow linear member, and (b) at least one internal perforated harrier formed by said perforated dome wherein said at least one internal perforated barrier is configured to prevent debris from flowing longitudinally through said perforated hollow linear member.

11. The method of claim 7, wherein said opposing linear portions are joined by a second at least one connection.

12. The method of claim 7, wherein said perforated dome comprises a center having a circular opening therein.

13. A gutter insert configured to rest inside an existing rain gutter and prevent said rain gutter from becoming obstructed with debris, said gutter insert comprising:

a) a perforated tubular body having a first end and a second end;

b) a perforated cylindrical body having a base and terminating in a perforated dome opposite said base, said perforated cylindrical body being connected to said first end by said base, wherein said perforated cylindrical body (i) has a cross section that is less than the cross section of said perforated tubular body, and (ii) is configured to nest within said second end;

c) wherein said perforated tubular body and said perforated cylindrical body are formed from a pair of opposing portions;

d) at least one hinge joining said pair of opposing portions; and e) a first one or more connecting means for holding said pair of opposing portions in a closed configuration.

14. The gutter insert of claim 13, wherein said pair of opposing portions are joined by a second one or more connecting means.

15. The gutter insert of claim 13, wherein said perforated dome comprises a center having a circular opening therein.

* * * * *